US005181460A

United States Patent [19]

Gremelsbacker

[11] Patent Number: 5,181,460

[45] Date of Patent: Jan. 26, 1993

[54] DEVICE FOR BUNDLING SHEET MATERIAL

[76] Inventor: John Gremelsbacker, 595 Broad Swamp Rd., Cheshire, Conn. 06410

[21] Appl. No.: 521,365

[22] Filed: May 10, 1990

[51] Int. Cl.[5] ..... B65B 13/18

[52] U.S. Cl. ..... 100/34; 211/50; 211/175; 248/149

[58] Field of Search ..... 100/1, 34; 211/50, 175; 248/149

[56] References Cited

U.S. PATENT DOCUMENTS

| | | | |
|---|---|---|---|
| D. 230,802 | 3/1974 | Morita | 100/34 X |
| 1,229,006 | 6/1917 | Zerwer | 100/34 X |
| 2,364,518 | 12/1944 | Clouser | 100/34 |
| 2,599,290 | 6/1952 | Schwenzer | 100/34 X |
| 2,818,180 | 12/1957 | Keene | 100/34 X |
| 3,038,403 | 6/1962 | Orelind | 100/34 |
| 3,129,819 | 4/1964 | Chandler | 100/34 X |
| 3,897,724 | 8/1975 | McDonald | 100/34 |
| 4,167,903 | 9/1979 | Lasher | 100/34 |

FOREIGN PATENT DOCUMENTS

| | | | |
|---|---|---|---|
| 566757 | 9/1975 | Switzerland | 100/34 |
| 575738 | 5/1976 | Switzerland | 100/34 |
| 579375 | 9/1976 | Switzerland | 100/34 |

*Primary Examiner*—Harvey C. Hornsby
*Assistant Examiner*—Stephen F. Gerrity
*Attorney, Agent, or Firm*—McCormick, Paulding & Huber

[57] ABSTRACT

A device for bundling sheet material having a support base and a plurality of guide members projecting upwardly from the base. Each of the guide members carries a shelf which is spaced above the support base. The upper surfaces of the shelves are disposed within a common horizontal plane above the support base and cooperate with the guide members to define an upwardly open channel for receiving sheets of waste paper of a predetermined size. Two of the guide members are adjustably positionable on and relative to the support base and to the other of the support members to adapt the device to receive sheets of material of differing sizes. A compartment is provided below one of the shelves for receiving a ball of twine which is paid out through an aperture on an associated one of the guide members for use in tying sheet material stacked in the device to form a bundle.

7 Claims, 2 Drawing Sheets

DEVICE FOR BUNDLING SHEET MATERIAL

BACKGROUND OF THE INVENTION

This invention relates in general to devices for bundling sheet material and deals more particularly with an improved adjustable device for bundling newspaper and waste paper sheets of other sizes.

The threat of eventual depletion of natural resources resulting from inadequate conversation polices and the risk of environmental pollution associated with the disposal of waste materials are problems of increasing national concern. The lack of available land for sanitary waste fill facilities and air pollution problems associated with incineration of waste materials are problems of immediate concern in most urban areas. Clearly, more attention needs to be devoted to recycling waste products wherever economically feasible.

It has proven both practical and economically feasible to recycle waste paper. Consequently, the average home owner may reasonably expect that in the future he will be required to spend more time in handling waste paper and preparing it for disposal in compliance with governmental regulations. Newspapers, for example, generally must be bundled for convenient handling in preparation for refuse pickup. Further, the small business concern will encounter substantially the same problem with respect to the disposal of business forms, letters and other waste paper.

It is the general aim of the present invention to provide an adjustable device to enable rapid collating and bundling of waste paper and like sheet material for convenient handling and disposal.

SUMMARY OF THE INVENTION

In accordance with the present invention, a device for bundling sheet material comprises a support base, a plurality of elongated guide members, and means for mounting the guide members on and in vertically upwardly extending relation to the support base in a selected one of a plurality of mounting positions wherein the guide members are horizontally spaced apart relative to each other. The device further includes a plurality of horizontally spaced apart shelves carried by the upwardly extending guide members. The shelves define upwardly facing support surfaces disposed within a common generally horizontal plane spaced upwardly from the support base. The guide members and the shelves cooperate in each selected mounting position to define an upwardly open guide channel for receiving a multiplicity of sheets of material of a predetermined size and collating the sheets in generally vertically stacked registry with each other and supporting the resulting stack of material in vertically spaced relation to the support base with a portion of the surface of the lowermost sheet of material in the stack exposed between the shelves and support members.

DETAILED DESCRIPTION OF PREFERRED EMBODIMENT

Figure 1:
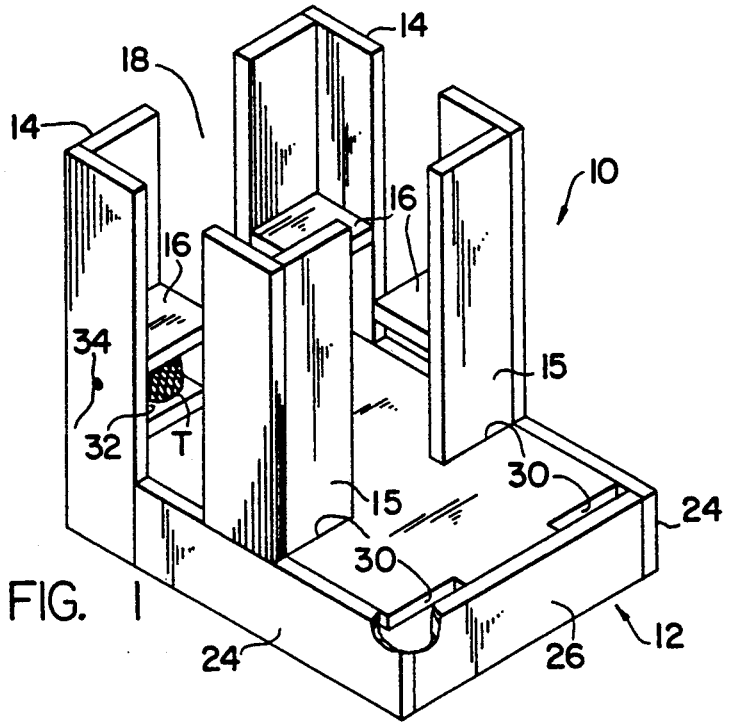
FIG. 1 is a perspective view of a device for bundling sheet material and embodying the present invention.
Figure 6:
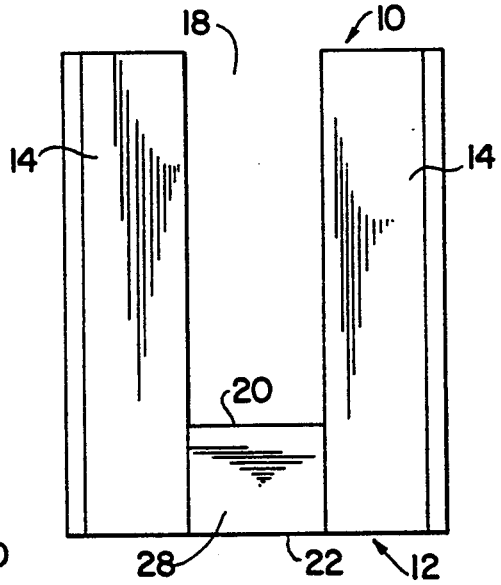
FIG. 6 is a rear elevational view of the device.
Figure 2:
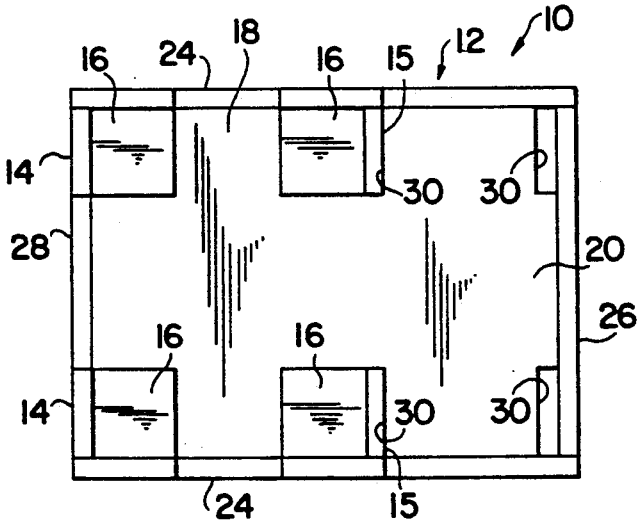
FIG. 2 is a top plan view of the device shown in FIG. 1.
Figure 3:
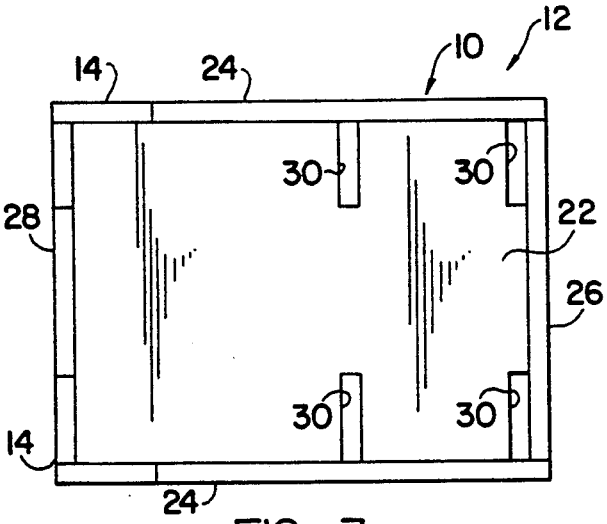
FIG. 3 is a bottom plan view of the device.

Turning now to the drawing, an adjustable device for bundling sheet material and embodying the present invention is indicated generally by the reference numeral 10. The illustrated device 10 is particularly adapted for bundling paper and the like and is adjustable to accommodate sheets of at least two different sizes, as, for example, folded newspaper and business forms.

The device 10, as shown, essentially comprises a support base indicated generally by the numeral 12 and a plurality of guide members 14,14 and 15,15. The guide members are mounted on and project upwardly from the support base 12 and carry shelves 16,16. The support members and the shelves 16,16 cooperate to define an upwardly open guide channel 18 for receiving a multiplicity of sheets of material S,S of a predetermined size. As each sheet S is inserted into the channel 18, it is collated with respect to other sheets S,S therebelow to form a stack of sheets in general vertical registry with each other. The shelves 16,16 support the resulting stack above and in vertically spaced relation to the support base 12 with a portion of the surface of the lowermost sheet of material S in the stack exposed between the shelves. This supporting arrangement allows a piece of string or twine to be passed under the stack and wrapped around it and tied to form a bundle, which may then be removed from the device and for convenient handling as a unit.

The adjustable bundling device of the present invention may be made in different sizes to accommodate sheet material of differing dimensions and in the drawings and description which follows an adjustable device for bundling folded newspaper having a length dimension of approximately 14 ½ inches and a width dimension of approximately 11 ½ inches or business paper having a length dimension of 11 inches and a width dimension of 8 ½ inches is shown and described.

Considering now the device 10 in further detail, it may be made from any suitable material, but preferably, and as shown, it is made from wood. The illustrated support base 12 is generally rectangular and includes horizontally disposed and vertically spaced apart top and bottom walls 20 and 22, and connecting walls which include opposing side walls 24,24 and front and rear end walls respectively indicated at 26 and 28.

The guide members 14,14 and 15,15 may take various forms, but preferably, and as shown, each guide member has a generally L-shaped transverse cross section and two legs formed by a pair of elongated generally rectangular strips of wood joined together along associated longitudinally extending edge portions.

Figure 7:
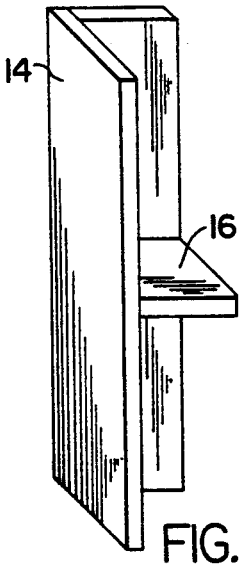
FIG. 7 is a perspective view of a fixed guide member.

At least one of the guide members is a fixed member mounted in stationary position relative to the base. However, the illustrated embodiment includes two fixed guide members designed 14,14. Each fixed guide members has two legs of equal length formed by two stripes of wood. The lower portions of the strips which form the guide members 14,14 are permanently attached to the support base and define associated portions of the rear end wall 28 and the side walls 24,24. A typical fixed guide member is shown in FIG. 7.

Figure 8:
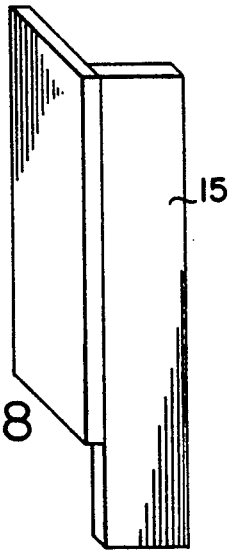
FIG. 8 is a perspective view of an adjustable guide member.
Figure 4:
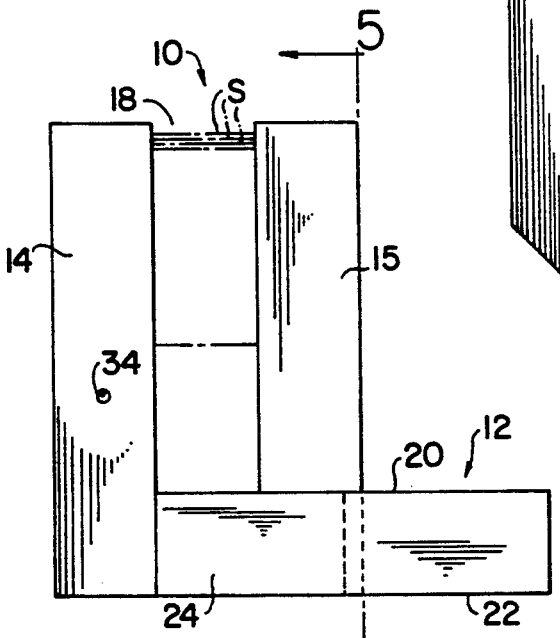
FIG. 4 is a side elevational view of the device.

The remaining two guide members 15,15 are adjustably positionalble relative to the support base 12. The two guide members 15,15 designated adjustable guide members, are of opposite hand and have legs of unequal length formed by generally rectangular strips of wood, one strip being longer than the other by a distance equal to the height dimension of the support base 12. A typical adjustable support member is shown in FIG. 8.

Each adjustable guide member 15 is arranged for selective positioning in an associated one of a plurality of possible mounting positions at an associated side of the support base and for this reason the support base 12 is provided with a plurality of slots 30,30. Each slot 30 substantially complements the cross sectional configuration of the longer leg on an associated guide member 15. Specifically, a plurality of identical slots 30, 30 are provided in the top wall 20 and the bottom wall 22. Each slot 30 in the top wall 20 is arranged in vertical registry with a corresponding slot 30 in the bottom wall 22. Each of the two adjustable guide members 15,15 are positioned in an associated pair of vertically aligned upper and lower slots 30,30. The adjustable guide members 15,15 cooperate with the fixed guide members 14,14 to define the corners of the upwardly open guide channel 18 which has a generally rectangular cross section.

Each guide member carries a shelf 16. The shelves may take various forms, but preferably, and as shown, each shelf 16 is generally rectangular and extends for some distance into the rectangular guide channel 18, substantially as shown. The shelves 16,16 have horizontally disposed upper surfaces which lie within a common horizontal plane when the adjustable support members 15,15 are properly positioned in the support base 12. Thus, the shelves 16,16 cooperate with the support guide members 14,14 and 15,15 to define the bottom of the guide channel 18 further defined by the upper portions of the guide members. It should be noted that, in assembly, the support members 14,14 and 15,15 are horizontally spaced apart relative to each other and the shelves 16,16 are also horizontally spaced apart relative to each other for a purpose which will be hereinafter further evident.

Figure 5:
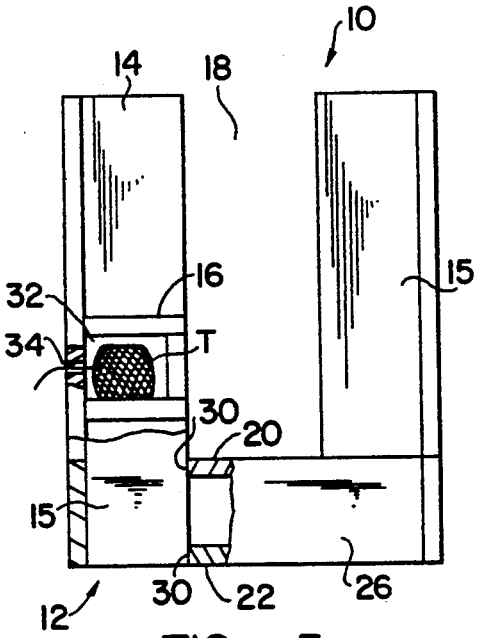
FIG. 5 is a front elevational view of the device shown partially in section taken generally along the line 5—5 of FIG. 4.

Preferably, and as shown, a string or twine receiving compartment 32 is provided in the space below the shelves 16,16 for receiving and holding a ball of string or twine, as best shown in FIG. 1 and in FIG. 5, where the ball of twine is indicated by the letter T. In the illustrated embodiment, the compartment is formed below one of the shelves and is partially defined by the shelf and portions of the guide member to which the shelf is attached. A twine receiving aperture 34 in the support member communicates with the interior of the compartment.

Preparatory to using the device, the adjustable guide members 15,15 are positioned in associated slots 30,30 in the support base 12 and relative to the fixed guide members 14, 14 to define a sheet material receiving channel 18 of the size required to accommodate the sheet material to be bundled. A ball of twine T is loaded into the compartment 32 with the free end of the twine extending outwardly through the twine receiving aperture 34, as shown in FIG. 5.

Sheets of paper or like material to be bundled are successively fed into the sheet receiving channel 18 in vertically stacked relation to each other. The lowermost sheet will rest on the shelves 16,16. It will now be evident that the purpose of the rectangular shelves is to increase the overall shelf support area to provide adequate support for the individual sheets and the resulting stack. Waste sheet material or paper may be stored in the device 10 until the stack reaches a desired height at which time the stack is bundled. Since the shelves support the stack above the support base 12 twine T paid out through the twine receiving aperture 34 may be passed under the lowermost sheet in the stack. The guide members and the shelves are spaced apart so that a central portion of the lowermost sheet in the stack is exposed between the shelves. This arrangement allows the twine T to be wrapped around the stack in one or two directions (i.e. front-to-rear and/or side-to-side) as desired, and tied to form a bundle. Preferably, the stack is tied in both directions that is longitudinally and transversely relative to the support base. Thereafter, the bundle may be removed from the device and handled as a unit.

I claim:

1. Device for bundling sheets of material and comprising a generally rectangular support base having horizontally disposed and vertically spaced apart top and bottom walls and vertically disposed connecting walls secured to and extending around the perimeter of said top and bottom walls, a plurality of vertically elongated guide members, each of said guide members having two vertically extending legs joined together to form a generally L-shaped transverse cross section, said guide members including at least one fixed guide member mounted in stationary position on said support base at one corner thereof and extending upwardly therefrom, said one guide member defining portions of two of said connecting walls, at least two adjustable guide members, one leg of each adjustable guide member having a lower end portion extending downwardly beyond the lower terminal end of the other leg thereof a distance substantially equal to the height dimension of the support base, means for mounting said adjustable guide members in a plurality of mounting positions on said support base and including a plurality of slots in said top wall disposed in vertical registry with corresponding slots in said bottom wall for receiving and complementing said lower end portions of the legs of said adjustable guide members, said adjustable guide members in said mounting positions being horizontally spaced apart relative to each other and to said one fixed guide member, a plurality of horizontally spaced apart shelves carried by said guide members and defining upwardly facing support surfaces disposed within a common generally horizontal plane spaced upwardly from said support base, said guide members and said shelves cooperating to define a generally rectangular upwardly open guide channel for receiving a multiplicity of rectangular sheets of material of one size when said adjustable guide members are mounted in one position on said support base and for receiving a multiplicity of rectangular sheets of material of another size when said adjustable guide members are mounted in another position on said support base, said guide members and said shelves cooperating to collate said sheets of material in generally vertically stacked registry with each other and support the resulting stack of material in vertically spaced relation to said support base with a portion of the lower surface of the lowermost sheet of material in said stack exposed between said shelves.

2. Device for bundling sheet material as set forth in claim 1 wherein said guide members define the four corners of said guide channel.

3. Device for bundling sheet material as set forth in claim 1 including means for supporting a ball of twine below said horizontal plane.

4. Device for bundling sheet material as set forth in claim 1 including means defining a compartment below one of said shelves for receiving and containing a ball of twine.

5. Device for bundling sheet material as set forth in claim 4 wherein said compartment is partially defined by said one shelf and a portion of an associated one of said guide members.

6. Device for bundling sheet material as set forth in claim 5 wherein said associated one of said guide members has a twine receiving aperture therethrough communicating with said compartment.

7. Device for bundling sheets of material and comprising a generally rectangular support base having horizontally disposed and vertically spaced apart top and bottom walls and means for securing said top and bottom walls in vertically spaced apart relation to each other, a plurality of vertically elongated guide members, each of said guide members having two vertically extending legs joined together to form a generally L-shaped transverse cross section, said guide members including at least one fixed guide member mounted in stationary position on said support base and at least two adjustable guide members, one leg of each adjustable guide member having a lower end portion extending downwardly beyond the lower terminal end of the other leg thereof a distance substantially equal to the height dimension of the support base, means for mounting said adjustable guide members in a plurality of different mounting positions on said support base and including a plurality of slots in said top wall disposed in vertical registry with corresponding slots in said bottom wall for receiving and complementing said lower end portions of the legs of said adjustable guide members, said adjustable guide members in said mounting positions being horizontally spaced apart relative to each other and to said one fixed guide member, a plurality of horizontally spaced apart shelves carried by said guide members and defining upwardly facing support surfaces disposed within a common generally horizontal plane spaced upwardly from said support base, said guide members and said shelves cooperating to define a generally rectangular upwardly open guide channel for receiving a multiplicity of rectangular sheets of material of one size when said adjustable guide members are mounted in one position on said support base and for receiving a multiplicity of rectangular sheets of material of another size when said adjustable guide members are mounted in another position on said support base, said guide members and said shelves cooperating to collate said sheets of material in generally vertically stacked registry with each other and support the resulting stack of material in vertically spaced relation to said support base with a portion of the lower surface of the lowermost sheet of material in said stack exposed between said shelves.

* * * * *